United States Patent [19]

Mack

[11] 4,290,868

[45] Sep. 22, 1981

[54] IRON PLUMBING CORROSION MINIMIZING METHOD

[76] Inventor: Michael H. Mack, 3101 S. Fairview Rd., No. 152, Santa Ana, Calif. 92704

[21] Appl. No.: 137,917

[22] Filed: Apr. 7, 1980

[51] Int. Cl.[3] ..... C23F 13/00

[52] U.S. Cl. ..... 204/148; 204/147; 204/196; 204/197

[58] Field of Search ..... 204/148, 197, DIG. 8, 204/147, 196

[56] References Cited

U.S. PATENT DOCUMENTS

| | | | |
|---|---|---|---|
| 2,443,599 | 6/1948 | Chester | 204/DIG. 8 |
| 3,342,712 | 9/1967 | O'Keefe | 204/197 |
| 3,477,930 | 11/1969 | Crites | 204/197 |
| 3,622,489 | 11/1971 | Dumitrescu et al. | 204/197 |
| 3,774,246 | 11/1973 | Beer | 204/DIG. 8 |
| 3,794,574 | 2/1974 | Fauth et al. | 204/197 |
| 4,133,725 | 1/1979 | Lerner et al. | 204/DIG. 8 |

*Primary Examiner*—G. L. Kaplan

*Attorney, Agent, or Firm*—William C. Babcock

[57] ABSTRACT

A method of minimizing corrosion in an iron plumbing system of the non-recirculating type through which water intermittently flows by interposing a magnesium anode therein that is electrically connected thereto to provide a galvanic couple. The magnesium in the anode after transforming from the atomic to the ionic state reacts with dissolved oxygen and carbon dioxide in the water to form soluble substantially non-corrosive magnesium salts. The magnesium anode unless subjected to water at a relatively high velocity tends to become enveloped in a protective film of magnesium hydroxide that renders it passive. By superimposing an alternating electric current on the galvanic cell the magnesium hydroxide is dislodged from the anode as it forms at the water interface, with magnesium dissolving into the water at a maximum rate to maintain the water at a pH of above seven and a maximum electrical potential between the anode and the iron plumbing.

2 Claims, 1 Drawing Figure

IRON PLUMBING CORROSION MINIMIZING METHOD

BACKGROUND OF THE INVENTION

1. Field of the Invention

Iron Plumbing Corrosion Minimizing Method.

2. Description of the Prior Art

In the past, devices have been used in iron and steel piping systems in which magnesium anodes are in contact with the water flowing therethrough, and the anode being electrically connected to the iron or steel system to provide a galvanic cell in which the magnesium rather than the iron or steel is subjected to corrosion.

An example of such a galvanic cell and method of using the same to protect an iron or steel piping system is disclosed and claimed in U.S. Pat. No. 3,342,712 entitled "Water Conditioning Method and Apparatus" that issued to William O'Keefe Sr. on Sept. 19, 1967.

The device disclosed in the O'Keefe patent as well as in other prior art patents have the operational disadvantage that the anode tends to have a thin film of magnesium hydroxide in a gelatinous form adhere thereto. The film so formed renders the magnesium passive and the galvanic couple has a limited benefit on the iron or steel piping system with which it is operatively associated unless the velocity of the water is sufficiently high as to constantly remove the film or the galvanic couple is in a closed system in which the water continuously recirculates preferably in a heated condition.

A major object of the present invention is to provide a method of minimizing corrosion of an iron or steel plumbing system in which water flows therethrough only intermittendly, and which method eliminates the operational disadvantages of prior art devices and methods that seek to minimize corrosion of piping systems by the use of a galvanic couple.

SUMMARY OF THE INVENTION

Confined space defining means are incorporated in an iron or steel plumbing system to support one or more anodes of magnesium in such a manner as to at all times be immersed in the water in the system. The anode is connected to the piping system by electrical conducting means to define a galvanic cell. The magnesium has a far greater tendency to be corroded by the water than the iron or steel of the system so long as the surface of the magnesium is maintained substantially free of a protective film of magnesium oxide or hydroxide. Thus, the magnesium and not the iron or steel of the piping system is subject to corrosion.

When the galvanic couple is incorporated in an iron or steel piping system in which there is an intermitting flow of water at a low velocity the protective film is not removed from the magnesium anode and the galvanic couple has limited corrosion preventing capability.

In the present invention, an alternating current is superimposed on the electric current generated by the galvanic couple, which alternating current dislodges magnesium oxide and hydroxide from the anode to constantly present a fresh face of magnesium metal to the water, and the galvanic couple operating at optimum efficiency to minimize corrosion of an iron or steel plumbing system even though the flow of water therethrough is intermittent and at low velocity.

DESCRIPTION OF THE PREFERRED EMBODIMENT

Figure 1:
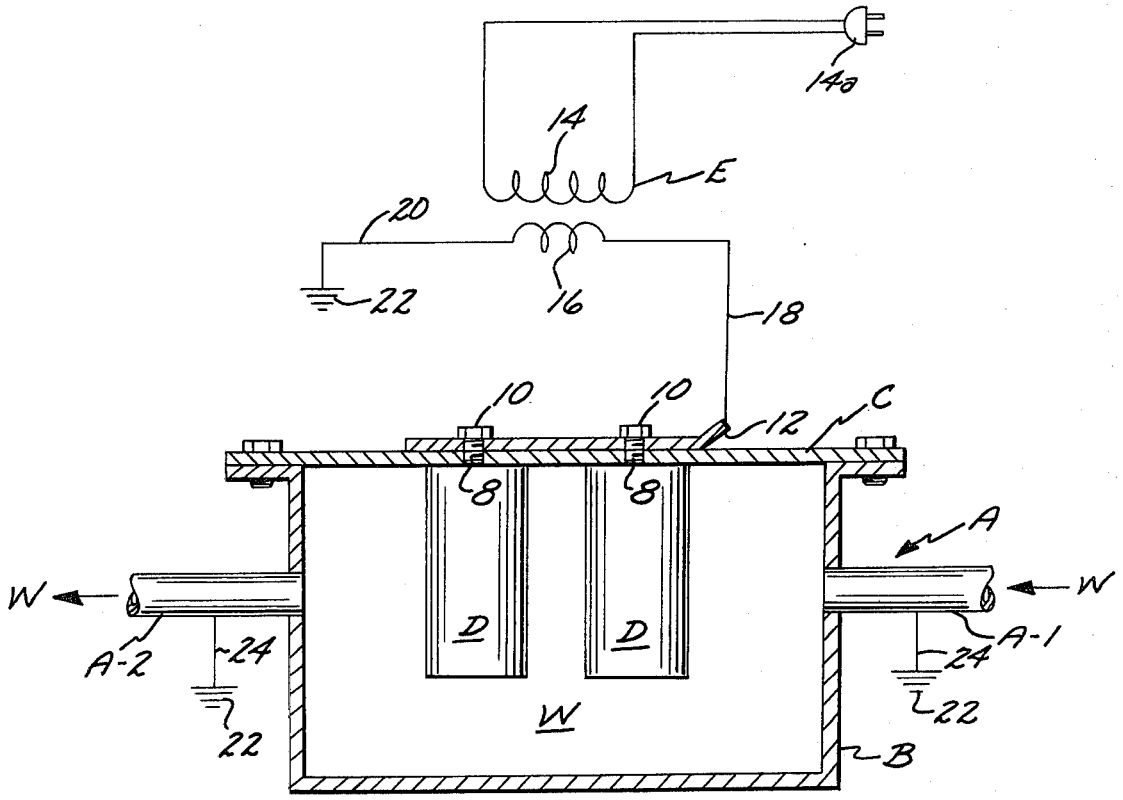
FIG. 1 is a diagrammatic view of an apparatus that may be used in carrying out the plumbing protecting method of the present invention.

When a copper-magnesium metal cell is located in the conduit of a circulating, softened water, the magnesium effectively reduces the quantity of dissolved oxygen present in the water:

$$Mg+\tfrac{1}{2}O_2+H_2O=Mg(OH)_2 \quad (1)$$

The driving force of this mechanism (2.30 volts) causes the magnesium metal (anode) to sacrifice itself while the iron or steel of the plumbing system remains as an indestructable electrode (cathode). In the process of progressively removing dissolved oxygen to a safe, noncorrosive level, the alkaline end-product, magnesium hydroxide, is produced according to the reaction of equation (1). If the pH of the circulating water is in the range of 4.5 to 8.3, free carbon dioxide gas is neutralized producing soluble magnesium bicarbonate:

$$2CO_2+Mg(OH)_2=Mg(HCO_3)_2 \quad (2)$$

Above pH 8.3 the content of free carbon dioxide gas is negligible and the continued formation of magnesium hydroxide produces magnesium carbonate by combining with the magnesium bicarbonate of equation 2:

$$Mg(HCO_3)_2+Mg(OH)_2=2Mg(O_3+2H_2O) \quad (3)$$

The magnesium carbonate remains in solution until, upon continuous production of magnesium hydroxide according to equation 1, the solubility of basic magnesium carbonate, $3\ MgCO_3\ Mg(OH)_2\ 3H_2O$, is exceeded at 0.04 gms/100 gm cold water and 0.01 gms/100 gms hot water. A visible flocculant precipitate will form at this time and the pH of the system will be approximately 8.9.

Probably the most significant factor about the magnesium sacrificial phenomenon lies in the different corrosion rates of ferrous metal in contrast to that of magnesium in oxygenated waters. Equation 1 illustrates that the driving force for magnesium can be considered to be 2.30 volts while that of iron is only 0.04 volts:

$$Fe+H_2O+\tfrac{1}{2}O_2=Fe(OH)_2 \quad (4)$$

Consequently the oxidation of iron is far slower and less complete than the reaction with magnesium and magnesium is sacrificed in place of valuable iron plumbing. The ratio of driving forces for a given set of environmental conditions is $Mg/Fe=2.30/0.04=57.5:1$.

The electrochemical process just described minimizes corrosion of a circulating process water in a number of very important ways.

An apparatus is shown in FIG. 1 of the drawing that permits a piping system of iron or steel to be protected by the use of magnesium even though the flow of water through the system is intermittent and at low velocity.

The iron or steel piping system A to be protected has a first portion A-1 connected to a pressurized source of domestic water W, and second portion A-2 that extends to the locations (not shown) where the water will be used.

An open top box B is provided that is in communication with both the piping systems A-1 and A-2. The box B is provided with a cover C. The cover C supports a metal conducting strip 12 that has one or more metal lugs 10 depending downwardly therefrom through openings 8 in the cover, and each lug supporting a magnesium anode D within the box B.

A transformer E is provided that has a primary 14 that is connected to a pronged plug 14*a* that may be inserted in a conventional alternating electricity outlet (not shown). The transformer E includes a secondary 16 that supplies low voltage alternating electric power, with one terminal being connected by a conductor 18 to strip 12, and the other terminal by a conductor 20 to ground 22. The first and second portions A-1 and A-2 are connected by conductors 34 to ground 22.

In operation, it will be seen from FIG. 1, that the anodes D and the first and second portions A-1 and A-2 of the piping system A cooperate to define a galvanic couple that generates an electromotive force that causes the magnesium rather than iron or steel of the system A to corrode as explained previously in detail. The transformer E super-imposes an alternating electric current on the galvanic cell assembly identified generally in the drawing by the letter F.

The alternating electric current causes magnesium oxide or hydroxide that forms as a substantially water impervious film on the anodes to be constantly dislodged therefrom, and the anodes in consequence at all times presenting fresh metal surfaces to the water W for the galvanic cell assembly F to operate at optimum efficiency even though the flow of water through the invention is intermittent and at low velocity. Should it be desired, a conventional timer may be provided to periodically control the electrical energization of the transformer E, rather than having the transformer operate continuously. The box B must be so located that the interior thereof is at all times flooded with water W.

The use and operation of the invention has been described previously in detail and need not be repeated.

What is claimed is:

1. A method of protecting an iron plumbing system through which water containing soluble calcium salts flows intermittently from corrosion and the build up of scale therein which includes the steps of:

a. disposing at least one magnesium anode in a confined space that forms a part of said system and is located in the portion of said system adjacent the location where said water enters the same;

b. establishing electrical communication between said anode and system to provide a magnesium-iron galvanic cell in which the magnesium of the anode at the interface with said water tends to transform from the atomic to the ionic state with a driving force substantially greater than the iron of said plumbing system so long as said interface surface is not protected by a film of magnesium oxide or magnesium hydroxide, said magnesium as it goes into solution in said water removing free oxygen and carbon dioxide therefrom as said magnesium is in part transformed to soluble magnesium bicarbonate and will so remain until the portion of magnesium in the water in the form of magnesium hydroxide raises the pH of said water to above 8.7, and at least a portion of the magnesium hydroxide formed being in the gelatinous lyophilic colloid state that envelops insoluble particles in suspension in the water to prevent them from settling out; and c. superimposing an alternating electric current on said magnesium iron galvanic cell to obtain optimum transformation of the magnesium in said anode from the atomic to the ionic state as said water flows by said anode.

2. A method as defined in claim 1 in which said alternating current is superimposed on said galvanic cell only to the extent that the pH of said water is not below seven.

* * * * *